United States Patent [19]

Terry et al.

[11] 3,935,639

[45] Feb. 3, 1976

[54] SAFETY RAZOR

[75] Inventors: John C. Terry; Steven V. Barnett, both of Tilehurst; John Lloyd, Wigston, all of England

[73] Assignee: The Gillette Company, Boston, Mass.

[22] Filed: Feb. 25, 1974

[21] Appl. No.: 445,431

[30] Foreign Application Priority Data

Mar. 13, 1973 United Kingdom ..... 10065/73

[52] U.S. Cl. ..... 30/47; 30/50; 30/87

[51] Int. Cl.[2] ..... B26B 21/22

[58] Field of Search ..... 30/38, 50, 57, 87, 47, 30/89

[56] References Cited

UNITED STATES PATENTS

| | | | |
|---|---|---|---|
| 1,089,726 | 3/1914 | Sharpivack | 30/87 X |
| 3,262,206 | 7/1966 | Tomek | 30/50 X |
| 3,396,464 | 8/1968 | Treiss | 30/87 X |
| 3,593,416 | 7/1971 | Edson | 30/50 |
| 3,685,150 | 8/1972 | Risher | 30/57 X |
| 3,740,841 | 6/1973 | Risher | 30/57 X |
| 3,777,396 | 12/1973 | Simonetti | 30/50 X |

*Primary Examiner*—Al Lawrence Smith
*Assistant Examiner*—Gary L. Smith

[57] ABSTRACT

A safety razor comprises an elongated handle that has a pair of arcuate, laterally spaced guide rails; a support member that has a pair of elongated guide means for sliding cooperation with the respective guide rails; a spring that acts between the handle and the support member to bias the support member towards a medial position of pivotal adjustment relative to the handle; and a shaving unit for detachable interengagement with the support member to position its cutting edge parallel to the pivotal axis.

14 Claims, 3 Drawing Figures

FIG 1
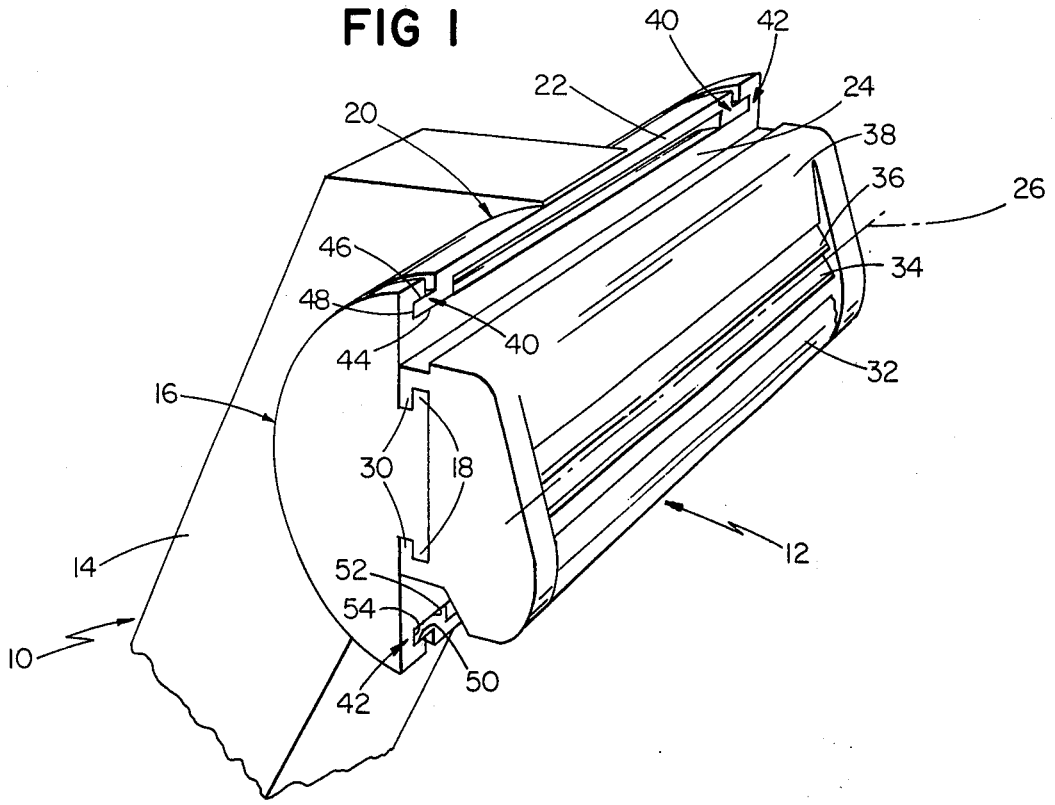
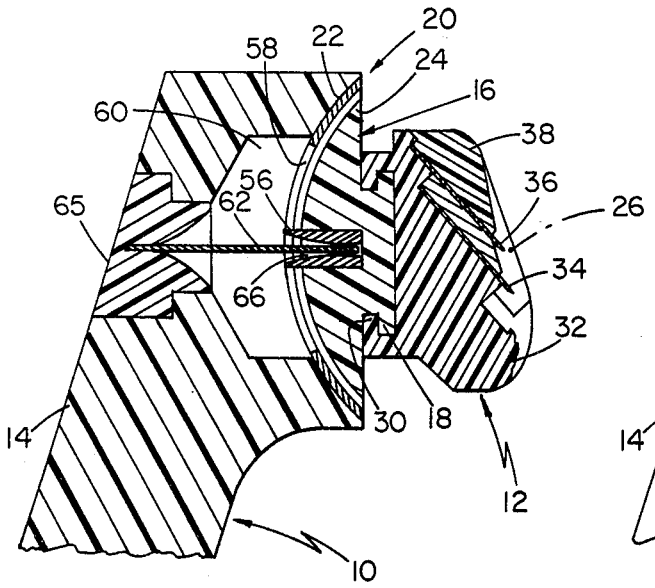
FIG 2
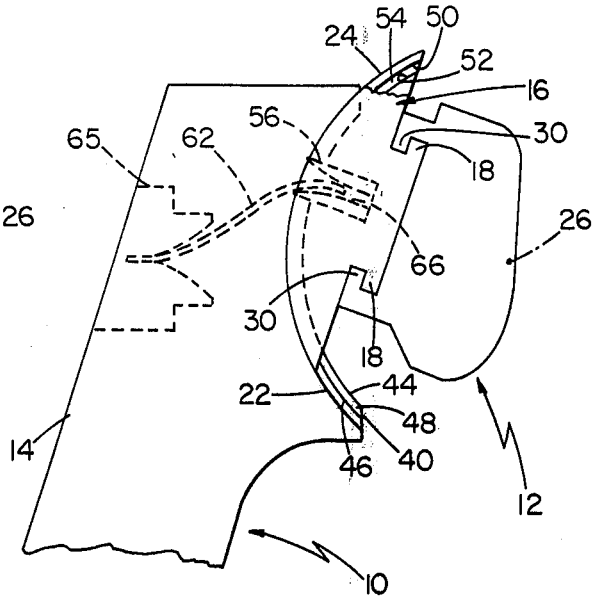
FIG 3

SAFETY RAZOR

SUMMARY OF THE INVENTION

This invention is concerned with safety razors.

Safety razors conventionally comprise a guard member and a cap member between which, in use, a razor blade is sandwiched, and a handle; the guard member, the cap member and the handle being fixed relative to one another in use. The latter feature is present in the conventional so-called three-piece razors designed to take disposable single or double-edged blades (such razors being called "three-piece" because the three parts mentioned above, that is the guard member, the cap member and the handle, can be separated); in the conventional so-called one-piece razors designed to take disposable single or double-edged blades (such razors being called "one-piece" because the three parts mentioned above are not separable); and in safety razors which have recently appeared on the market which comprise, instead of a disposable razor blade, a disposable shaving unit or head which comprises a guard member, one or more blades, and a cap member held rigidly together, the shaving unit being rigidly attachable to a handle and being replaced as a whole when the cutting edge or edges become blunt.

In the following description we will, for convenience, refer to the combination of the guard member, the blade or blades, and the cap member as the shaving unit, and it is to be understood that this expression is intended to cover combinations of these elements in which the elements are permanently secured together, the whole shaving unit being replaced when the cutting edge or edges become blunt, and also combinations in which these elements are not permanently secured together and in which the cap member and the guard member are separable to permit replacement of the blade or blades only.

Razors in which there is a fixed relationship between the shaving unit and the handle, call for considerable dexterity on the part of the user and substantial changes in the disposition of the handle in order to maintain the shaving unit at the optimum attitude on the shaver's face, particularly when negotiating areas, such as the jaw line, where there are gross changes in facial contour. It has been proposed to improve the shaving characteristics of razors by providing a handle with a yoke structure and a blade carrier with pins projecting outwardly from opposite ends of the carrier, the pins of the blade carrier being received in the yoke structure so that the blade carrier may rock relative to the handle. Such proposed arrangement has certain drawbacks and disadvantages including cumbersome lengthening of the razor beyond the ends of the blades and portions that project above the shaving plane and interfere with shaving, and it is an object of this invention to provide a novel and improved razor in which the shaving unit is movable as a unit relative to the handle.

Another object of the invention is to provide a novel and improved razor that employs a replaceable shaving unit and that is sturdy and reliable in use.

In accordance with the invention there is provided a razor that includes a handle and a transversely extending blade support portion at one end of the handle. This support structure has an outwardly facing surface and may have one or more blade elements and cooperating skin engaging structures such as cap and guard structures permanently secured to it, but preferably is arranged to receive a replaceable shaving unit which has a body of plastic material to which a blade element is permanently secured. Structure connecting the handle and support portion and permitting movement of the support portion relative to the handle during the course of a shaving stroke is located on the side of the support portion remote from the outwardly facing surface and includes a smoothly curved bearing surface of finite length, the ends of the smoothly curved bearing surface being located rearwardly of the outwardly facing surface, and a cooperating surface in engagement with smoothly curved bearing surface.

In a preferred embodiment the connecting structure includes juxtaposed, spaced, inner and outer, arcuate bearing segments, each said bearing segment being less than 180° in angular extent, and a cooperating hollow shaft segment also of less than 180° in angular extent. The inner and outer surfaces of the hollow shaft segment are received in bearing engagement with the inner and outer bearing segments, and the interengaged bearing segments and shaft segment define an axis of rotation of the support portion located immediately adjacent the active elements of the shaving system and extending parallel to the cutting edge of the shaving system.

In a particular embodiment the bearing assembly includes two sets of axially spaced bearing segments and cooperating hollow shaft segments, each set in the form of interengaged flange and groove elements, the ends of the flange elements cooperating with the base of the groove element in thrust bearing relation. The flange elements may be inwardly directed or outwardly directed and may be formed on the same component of the bearing assembly or one component of the bearing assembly may include both a flange portion and a groove portion.

The razor also includes restoring structure arranged to generate a force when the support portion is offset from a medial position relative to the handle that tends to move the support portion towards the medial position, which in a particular embodiment is a leaf spring portion extending between handle and the supporting portion. The leaf spring may function as a stop structure or separate stop structure for limiting the relative movement of the support portion relative to the handle may be employed. Stop structure limits the range of pivotal movement of the shaving unit preferably in the range of 20°–90°.

When using a razor according to the invention, it has been found that the shaving unit accommodates itself readily to changes in facial contours.

It is not normally necessary for the shell bearing assembly and/or the spring means to permit the shaving unit to pivot through more than 90° and it is generally preferred that the possible rotation should be through at least 20°. The medial position to which the spring means urges the shaving unit is preferably the center point of the possible rotation.

Further advantages and preferred features of the invention will appear from the following description of a particular embodiment of the invention, given with reference to the accompanying drawings, in which:

FIG. 1 is a perspective view of an embodiment of a razor in accordance with the invention;

FIG. 2 is a sectional view of the razor shown in FIG. 1; and

FIG. 3 is a side view of the razor shown in FIG. 1 showing the shaving unit in a position of maximum rotation.

DESCRIPTION OF PARTICULAR EMBODIMENT

The razor shown in FIG. 1 includes a handle component 10 and a shaving unit component 12. The handle component includes an elongated grip portion 14 that is of generally square crosssectional configuration with a slight taper along its axial length. At the upper end of the grip portion is a transversely extending supporting structure 16 that includes outwardly directed rail or flange elements 18. Structure 16 is secured to grip 14 by connector structure 20 disposed between grip portion 14 and support portion 16 that includes cooperating interengaged shell bearing members 22, 24 that permit movement of support structure 16 relative to grip portion 14 about axis 26 that is spaced beyond support structure 16 and extends parallel to the rail elements 18.

Shaving unit 12 is detachably mounted on the support structure 16 by means of inwardly directed rails 30 on the base of the shaving unit, which clip or slide over the longitudinal edges of the flanges 18 to secure that shaving unit to the support structure in manner similar to the razor handle coupling arrangement shown in Perry U.S. Pat. No. 3,768,162. The shaving unit 12 comprises a guard portion 32, spaced blade elements 34 and 36 and a cap portion 38, all secured permanently together, the complete unit being discarded when the cutting edges are blunt and replaced by a fresh unit. A variety of types of blade units may be secured to the handle component, including for example the several types of blade units shown in the abovementioned Perry patent.

Rigidly secured to the upper end of grip 14 is a transversely extending outer part-cylindrical shell bearing member 22 of suitable material such as brass to which is attached an inner part-cylindrical shell bearing member 24 which may be of molded plastics. Outer shell bearing member 22 has an axially outwardly extending part-cylindrical flange 40 at each end, and inner shell bearing member 24 has an axially inwardly directed part-cylindrical, undercut groove 42 at each end. Formed on the outward face of the inner shell bearing member 24, opposite its curved surface, is support structure 16.

Each flange 40 is in the form of a segment of a hollow cylindrical shaft that has an inner surface 44, an outer surface 46 and an end surface 48. Each groove 42 defines juxtaposed, inner and outer, arcuate bearing segments 50, 52, respectively, each of about 120° angular extent and a base surface 54. The shell bearing members 22, 24 are slidably attached together by reception of flanges 40 within grooves 42 so that the surfaces 44, 46 of shaft segments 40 are received in radial bearing engagement with the surfaces of bearing segments 50, 52 and end surfaces 48 are in thrust bearing engagement with base surfaces 54.

After the bearing members 20, 22 are so attached, stop member 56 is inserted through slot 58 in the outer shell bearing member 22 and secured to the inner shell bearing member 24 as indicated in FIG. 2, stop member 56 and slot 58 being so dimensioned that movement of the inner shell bearing member 24 with respect to the outer shell bearing member 22 may only take place within the limits defined by the ends of slot 58 and stop member 56.

Handle 10, as indicated in FIG. 2, includes a recess 60 in which a leaf spring 62 is disposed. The rear end of spring 62 is secured to insert 65 which in turn is secured to handle grip portion 14 and the spring extends forward through slot 58 in the outer shell bearing member 22. The forward free end of spring 62 is located within recess 66 in projecting stop member 56 carried by the inner shell bearing member 24. The radius of curvature of surfaces 44, 46, 50 and 52 of the shell bearing members 22, 24 is such that the effective axis 26 of rotation of the shaving unit 12 is adjacent to and parallel with the cutting edges of blades 34 and 36 and approximately midway between the skin engaging surfaces of cap 38 and guard 32 of the shaving unit 12. More specifically, the axis 26 is subtended between complimentary arcuate guide surfaces presented between grooves 42 and flanges 40. In an alternative arrangement projecting stop 56 may be omitted and the free end of spring 62 located within a recesss in the inner shell bearing member 24, the slot 58 and the recess being so dimensioned that the movement of inner shell bearing member 24 with respect to the outer shell bearing member 22 may only take place within limits defined by the leaf spring 62 abutting the end of the slot and the recess.

During a shaving stroke, the active elements of the shaving unit, e.g. the blades 34, 36 and cooperating leading and following surfaces 32 and 38, are permitted to move as a unit independently of the position of handle 10 to follow the configuration of the skin surface being shaved during each shaving stroke, the shaving unit rotating about axis 26. In this embodiment the plane of the active elements of the shaving system is allowed to swing in either direction from the medial position shown in FIG. 2, the engagement of projection 56 with the upper end of slot 58 limiting movement in one direction, as shown in FIG. 3, and the engagement of projection 56 with the lower end of slot 58 providing a limit on motion in the other direction. Leaf spring 50 serves to bias the shaving unit 12 towards a medial position of its permitted pivotal movement and acts to continuously impose a light restoring force that tends to return the shaving unit to its medial position when the unit is offset therefrom.

The above described arrangement is employed to particular advantage when the shaving unit comprises two blade elements whose respective cutting edges are parallel with and close to each other, the edges operating in tandem during use of the razor. The pivotal mounting of the shaving unit helps to ensure, in such cases, that proper use is made of the second edge, i.e. that both edges, and not just the first or leading edge, play their part in the shaving operation.

While a particular embodiment of the invention has been shown and described, various modifications thereof will be apparent to those skilled in the art and therefore it is not intended that the invention to the disclosed embodiment or to details thereof and departures may be made therefrom within the spirit and scope of the invention as defined in the claims.

What is claimed is:

1. A safety razor comprising a handle, a transversely extending support portion at one end of said handle, said support portion having an outwardly facing surface on which a shaving element is adapted to be carried in shaving position, structure connecting said handle and support portion for angular rotation of said support portion relative to said handle in either direction from a medial position about an axis extending transversely of said supporting portion parallel to and immediately adjacent to a blade edge position as defined by said support portion, said connecting structure being located on the side of said support portion remote from said outwardly facing surface and including interengaged flange and groove elements, the ends of said flange elements cooperating with the bases of said groove elements in thrust bearing relation, said connecting structure permitting pivotal movement of said support portion relative to said handle during the course of a shaving stroke, and restoring structure arranged to generate a force when said support portion is offset from said medial position relative to said handle tending to move said support portion towards said medial position.

2. A safety razor as claimed in claim 1 wherein said flange and groove elements include juxtaposed, spaced, inner and outer arcuate bearing segments, each said bearing segment being less than 180° in angular extent, and a cooperating hollow shaft segment also of less than 180° in angular extent, the inner and outer surfaces of said hollow shaft segment being received in bearing engagement with said inner and outer bearing segments.

3. A safety razor as claimed in claim 1 wherein said restoring structure tends to maintain said support portion in said medial position.

4. A safety razor as claimed in claim 3 wherein said restoring structure includes a leaf spring portion extending between said handle and said support portion, and further including stop structure for limiting the relative rotational movement of said support portion relative to said handle.

5. A safety razor as claimed in claim 1 wherein said support portion includes coupling structure for detachably mounting a shaving unit on said outwardly facing surface.

6. A safety razor as claimed in claim 1 wherein said connection structure includes two sets of axially spaced bearing segments and cooperating hollow shaft segments.

7. A safety razor as claimed in claim 1 wherein the range of pivotal movement of said shaving unit is in the range of 20°–90°.

8. A safety razor as claimed in claim 7 wherein said connecting structure includes juxtaposed, spaced, inner and outer arcuate bearing segments, each said bearing segment being less than 180° in angular extent, and a cooperating hollow shaft segment also of less than 180° in angular extent, the inner and outer surfaces of said hollow shaft segment being received in bearing engagement with said inner and outer bearing segments, said interengaged bearing segments and shaft segment defining an axis of rotation of said support located immediately adjacent the active elements of the shaving system and extending parallel to the cutting edge of the shaving system.

9. A safety razor as claimed in claim 1 and further including a shaving unit comprising two blade elements whose respective cutting edges are parallel with and close to each other, the edges operating in tandem during use of the razor and being disposed immediately adjacent said axis.

10. A safety razor comprising a handle, a transversely extending support portion at one end of said handle, said support portion having an outwardly facing surface on which a shaving element is adapted to be carried in shaving position, structure connecting said handle and support portion, said connecting structure being located on the side of said support portion remote from said outwardly facing surface and including juxtaposed, spaced, inner and outer arcuate bearing segments, each said bearing segment being less than 180° in angular extent, and a cooperating hollow shaft segment also of less than 180° in angular extent, the inner and outer surfaces of said hollow shaft segment being received in bearing engagement with said inner and outer bearing segments, said interengaged bearing segments and shaft segment defining an axis of rotation of said support portion located immediately adjacent the active elements of the razor and extending parallel to the cutting edge of the razor, said connecting structure permitting pivotal movement in the range of 20°–90° of said support portion relative to said handle during the course of a shaving stroke, and restoring structure arranged to generate a force when said support portion is offset from a medial position relative to said handle tending to move said support portion towards said medial position.

11. A safety razor as claimed in claim 10 wherein said restoring structure includes a leaf spring portion extending between handle and said support portion, and further including stop structure for limiting the relative movement of said support portion relative to said handle.

12. A safety razor comprising:

an elongated handle presenting a pair of guide rails spaced apart laterally of the handle and each of arcuate form;

a support member having a pair of arcuate guide means for sliding co-operation with said respective guide rails, said guide rails and said guide means defining a connection between said handle and said supporting member whereby said support member is mounted on said handle for pivotal movement relative to said handle about a pivotal axis that extends transversely of said handle, said pivotal axis being spaced further from said handle than from said support member;

spring means acting between said handle and said support member and operative to bias said support member towards a medial position of pivotal adjustment relative to said handle;

and a shaving unit comprising a guard member, a cap member and blade means presenting at least one cutting edge, said blade means and support member having means for detachable interengagement in such a manner as to position said cutting edge parallel with and adjacent said pivotal axis.

13. A safety razor as claimed in claim 12 wherein said range of pivotal movement is from 20° to 90° and said medial position is disposed centrally of said range of pivotal movement.

14. A safety razor as claimed in claim 13 wherein said shaving unit comprises two blade elements whose respective cutting edges are parallel with and close to each other, the edges operating in tandem during use of the razor.

* * * * *

UNITED STATES PATENT AND TRADEMARK OFFICE

CERTIFICATE OF CORRECTION

PATENT NO. : 3,935,639

DATED : February 3, 1976

INVENTOR(S) : John C. Terry et al.

It is certified that error appears in the above-identified patent and that said Letters Patent are hereby corrected as shown below:

Under "References Cited", change the spelling of the first reference from "Sharpivack" to --Sharpnack--.

Column 2, line 42, change "supporting" to --support--.

Column 3, line 7, change "crosssectional" to --cross-sectional--;
line 9, change "supporting" to --support--.

Column 4, line 17, change "recesss" to --recess--;
line 55, after "invention", insert --be limited--.

Column 5, line 1, change "supporting" to --support--;
line 54, after "support", insert --portion--.

Signed and Sealed this twenty-fifth Day of May 1976

[SEAL]

Attest:

RUTH C. MASON
*Attesting Officer*

C. MARSHALL DANN
*Commissioner of Patents and Trademarks*